United States Patent [19]

Cobb et al.

[11] 4,231,726

[45] Nov. 4, 1980

[54] GEAR PUMP HAVING FLUID DEAERATION CAPABILITY

[75] Inventors: Delwin E. Cobb, Peoria; Maurice E. Young, Washington, both of Ill.

[73] Assignee: Caterpillar Tractor Co., Peoria, Ill.

[21] Appl. No.: 918,123

[22] Filed: Jun. 22, 1978

[51] Int. Cl.[3] ..... F04C 2/18; F04C 15/00

[52] U.S. Cl. ..... 418/75; 418/206

[58] Field of Search ..... 418/15, 75, 78, 80, 418/180, 205, 206

[56] References Cited

U.S. PATENT DOCUMENTS

| | | | |
|---|---|---|---|
| 2,345,975 | 4/1944 | Herman | 418/74 |
| 2,541,010 | 2/1951 | Ungar | 418/78 |
| 2,923,249 | 2/1960 | Lorenz | 418/78 |
| 3,057,303 | 10/1962 | Lauck | 418/78 |
| 3,174,435 | 8/1962 | Sisson et al. | 418/206 |
| 3,204,564 | 9/1965 | Eltze | 418/78 |
| 3,267,862 | 8/1966 | Mosbacher | 418/15 |
| 3,280,756 | 10/1966 | Gordon | 418/74 |
| 3,291,060 | 12/1966 | Bottoms | 418/15 |
| 3,313,238 | 4/1967 | Muller et al. | 418/206 |
| 3,526,470 | 9/1970 | Swanson | 418/15 |
| 3,558,247 | 1/1971 | Gaertner | 418/131 |
| 3,898,025 | 8/1975 | Bottoms | 418/170 |

FOREIGN PATENT DOCUMENTS

| | | | |
|---|---|---|---|
| 2631341 | 1/1978 | Fed. Rep. of Germany | 418/206 |

*Primary Examiner*—John J. Vrablik

*Attorney, Agent, or Firm*—Charles E. Lanchantin, Jr.

[57] ABSTRACT

A gear pump (10) has a pair of intermeshing gears (12,14) located in a corresponding pair of intersecting cavities (16,18) in a housing (20), and air bleed passages (60) are defined in the housing (20) for passing entrained air collected in the fluid at the tooth roots (42) of the gears (12,14) as a result of centrifugal force away from a preselected region (61,62) of each of the gear cavities (16,18). Preferably, a pair of arcuate air bleed passages (64) are formed in the housing (20) and are located in a trailing portion (62) of the preselected region, and a pair of grooves (70) transmit pressure from a discharge opening (48) back to the tooth roots (42) to positively encourage movement of fluid with entrained air toward the arcuate air bleed passages (64).

15 Claims, 6 Drawing Figures

GEAR PUMP HAVING FLUID DEAERATION CAPABILITY

TECHNICAL FIELD

The present invention relates to a gear pump, and more particularly to a gear pump that has a pair of intermeshing gears in a housing and fluid deaeration capability in use.

BACKGROUND ART

Positive displacement pumps having a pair of intermeshing driven and driving spur gears located in a pair of intersecting housing cavities are well known. In addition to the usual problems, when these pumps are used for scavenging varying amounts of hydraulic fluid from a tank of a vehicle traversing uneven terrain, there is often an excessive amount of entrained air present in the fluid passing through the pump. This not only lowers the overall effectiveness of those sump pumps, but also results in an undesirable amount of air returning with the fluid to the parent supply system so that operation of other components associated with the vehicle's main supply system can be adversely influenced. Moreover, there is often a great need to keep these auxiliary scavenge or sump pumps simple in construction for economic reasons, and as compact as possible to make best use of available space.

DISCLOSURE OF INVENTION

In one aspect of the present invention one or more of the problems as set forth above are overcome. This is accomplished by providing air bleed passage means in the housing of a gear pump having intermeshing gears for passing entrained air collected in the fluid at the gear tooth roots as a result of centrifugal force away from a preselected region of each of the gear cavities in the housing.

Particularly, the housing has defined therein at least one air bleed passage for communicating air bubbles in the fluid being pumped away from a side face of each of the gears. Preferably the air bleed passages are symmetrically arranged with respect to the midplane between the gears, and the pressure in the outlet opening is communicated back to the teeth of the gears for a preselected angular region of these gear cavities to aid the movement of entrained air toward the air bleed passages along the side faces of the gears.

Advantageously, a gear pump having the construction of the present invention can be utilized in a vehicle sump that is only partially filled with hydraulic fluid, for example. Despite the fact that a portion of the pump might be protruding above the variable fluid level, or that there is only a minimal amount of fluid, the pump is effective to return fluid with a reduced amount of entrained air back to the main reservoir or supply system when compared with known prior art pumps. This is accomplished, at least in part, by providing greater clearance than normal between the side face of the gears and the housing so that the air bubbles may travel radially inwardly for collection in the air bleed passages.

BEST MODE FOR CARRYING OUT THE INVENTION

Figure 1:
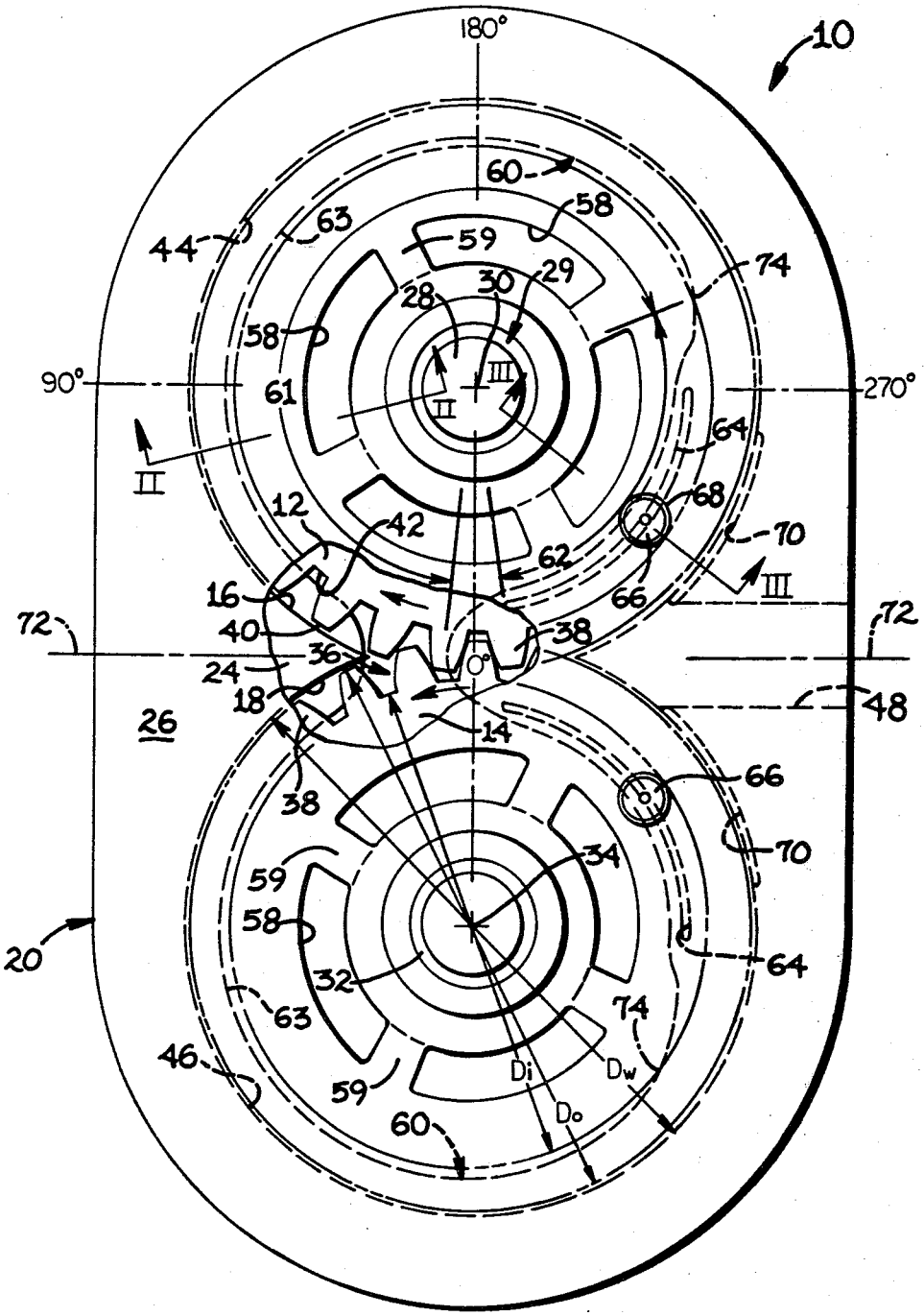
FIG. 1 is a diagrammatic plan view of one embodiment of the gear pump of the present invention with a portion broken open to better illustrate details of its construction.
Figure 2:
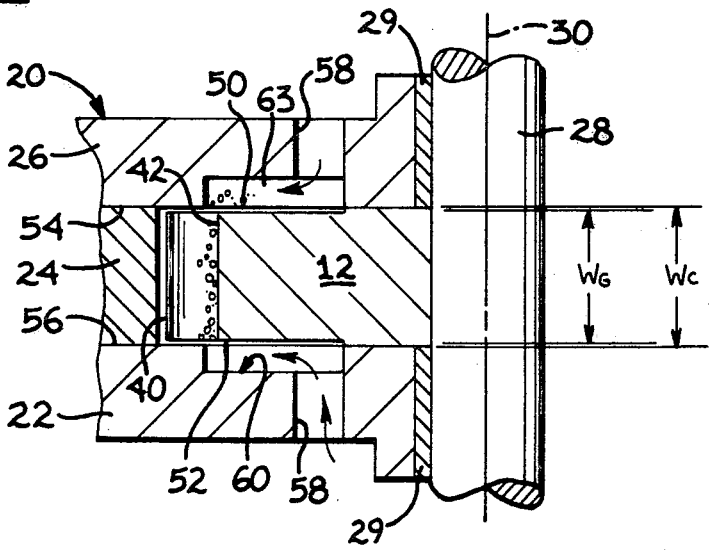
FIG. 2 is a diagrammatic, fragmentary sectional view of the gear pump of the present invention as taken along line II—II of FIG. 1.
Figure 3:
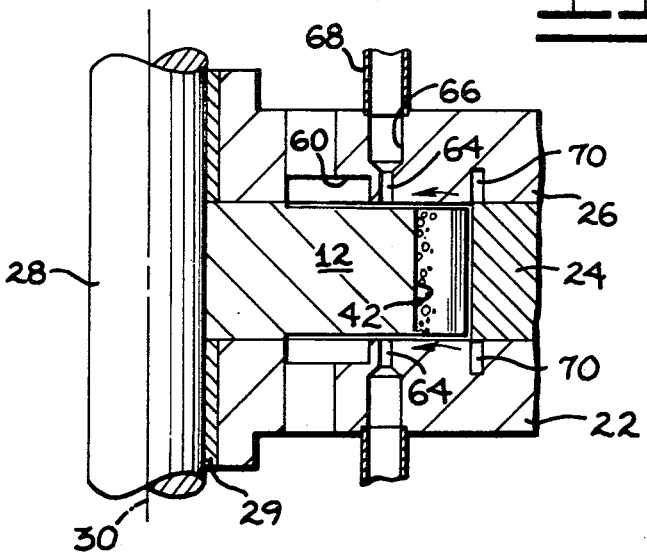
FIG. 3 is a view similar to FIG. 2, only taken along line III—III of FIG. 1.

One embodiment of a gear pump 10 having fluid deaeration capability and constructed in accordance with the present invention is illustrated in FIG. 1. The gear pump 10 has a pair of intermeshing spur gears 12 and 14 nested respectively in a pair of intersecting gear cavities 16 and 18 formed in a three-piece housing 20. As best shown in FIGS. 2 and 3 the preferably horizontally oriented housing has a lower cover or closure plate 22, a central body portion 24 and an upper cover or closure plate 26 sealingly secured together in a releasable sandwich as is known in the art.

Referring now to FIG. 1, the first or driving gear 12 located in the upper part of that figure is releasably secured to a drive shaft 28 for powered rotation within a pair of spaced cylindrical bushings 29 in a clockwise direction about a first upright axis 30. The second or driven gear 14 located in the lower part of the figure is mounted on a cylindrical bushing 32 for free rotation in a counterclockwise direction about a second upright axis 34. Thus, it is apparent that the spur gears intermesh at a zero degree position located on a plane through the gear axes 30 and 34, and subsequently move to the left when viewing FIG. 1 to separate and provide a region of suction or vacuum 36 thereat.

Each of the gears 12 and 14 has a plurality of gear teeth 38 defining a corresponding plurality of alternating tooth tips 40 and tooth roots 42. Accordingly, the tooth tips generally define a cylinder having an outside diameter $D_o$ and the tooth roots generally define a cylinder having an inside diameter $D_i$ as is noted in FIG. 1.

In the instant example each gear tooth 38 rotates approximately 20° from the zero degree position prior to mating with first and second walls 44,46 formed in the body 24 of the housing 20. Moreover, each gear tooth exists from the walls and into open communication with a discharge opening 48 formed in the body at the 310° position of tooth rotation. Preferably the diameter $D_w$ of the walls 44,46 is about 0.10 mm to 0.15 mm (0.004" to 0.006") larger than the diameter $D_o$ of the gears 12,14.

As representatively shown in FIG. 2, the width $W_G$ of each of the gears 12,14 is defined between the faces 50,52 and the width $W_C$ of each of the cavities 16,18 is defined between the cover plate faces 54,56. Preferably, the gears side clearance or difference defined by subtracting these two widths and dividing by two is substantially larger than is conventionally the case. For example, while the usual prior art pump has less than about 1.1 mm (0.045") side clearance, the gear pump 10 has preferably more than about 1.3 mm (0.051") side clearance for reasons that will subsequently be appreciated.

Referring now to FIGS. 1 and 2, a plurality of fluid inlet openings 58 are provided in at least one of the cover plates 22,26 for permitting a fluid such as hydraulic fluid residing in the sump, not shown, to be drawn into the gear pump 10. In the instant embodiment four arcuate openings 58 are defined in each of the cover plates adjacent each side of the gears 12,14. These arcuate openings are located radially inwardly of the tooth roots 42 and serve to define a plurality of radially oriented ribs 59 therebetween for providing support for bushings 29,32.

In carrying out the present invention, air bleed passage means 60 is defined in the housing 20 arcuately around a preselected angular region of each of the cavities 16,18. In general, such air bleed passage means includes a leading first portion 61 and an adjacent trailing second portion 62 as indicated in FIG. 1 by the arc-embracing arrows.

In the instant embodiment, the air bleed passage means 60 includes a common inlet chamber or opening 63 formed in at least one of the cover plates 22,26 and openly communicating with the inlet openings 58. As shown in FIGS. 1 and 2 the common inlet chamber 63 opens radially outwardly beyond or overlaps the tooth roots 42 throughout the leading first portion 61, or from about 5° to about 245°. This advantageously provides an ingress path for fluid into the area of the gear teeth 38 and also provides an egress path for controllably releasing accumulated air at the tooth roots 42 as a result of the centrifugal force acting upon the fluid.

The air bleed passage means 60 further includes an arcuate air bleed passage 64 adjacent the outlet of each gear 12,14. These air bleed passages are separated or spaced from the common inlet chamber 63 and are defined in at least one of the cover plates 22,26 as shown in FIGS. 1 and 3 for more positive exhausting of entrained air in the fluid near the pressurized discharge opening 48. Each of the passages 64 is desirably located in the trailing second portion 62, or generally in the fourth quadrant as, for example, extending from about 270° to about 355°. The passages 64 are desirably disposed radially inwardly from the tooth roots 42 and radially outwardly of the common inlet chamber 63. An exit port 66 is preferably located intermediate the ends of each of the passages 64 to communicate aereated fluid axially outwardly to a standpipe 68 and back to the sump, not shown, away from the inlet openings 58.

Preferably, a pressure transmitting groove 70 is formed in one of the cover plates 22,26 and body 24 radially outwardly of each of the air bleed passages 64 adjacent the tooth tips 40 and in the region of the trailing portion 62. In this manner the relatively higher pressure existing in the discharge opening 48 may be communicated back to a point around the periphery of the gears 12,14 where it will encourage movement of fluid with entrained air toward the air bleed passages 64. While the grooves 70 illustrated in FIGS. 1 and 3 are defined in both cover plates, it is contemplated that such grooves can alternately be formed as an outward step in the cavity walls 44,46 at the same angular location of from about 275° to about 310°.

INDUSTRIAL APPLICABILITY

The subject gear pump 10 is useful in a pressurized hydraulic fluid system for reducing the transfer of air from a remotely disposed sump back to the principal reservoir. Filters, especially-baffled tanks, and air-bleed valves are typical of the devices heretofore used to deaerate such fluid systems on earthmoving machinery, for example. However, as earthmoving equipment becomes more complex, and the equipment is operated at conditions of greater angularity to the horizontal, and with increased vibration, these prior devices become increasingly unsatisfactory.

The subject gear pump 10 is especially adaptable to the rock breaker disclosed in U.S. Pat. No. 3,868,145 issued Feb. 25, 1974 to D. E. Cobb, et al and in U.S. Pat. No. 4,030,566 issued June 21, 1977 to D. E. Cobb, et al. Such rock breaker is remotely located with respect to the principle reservoir and orientable into a number of different positions. The rock breaker has componentry requiring continuous lubrication and cooling, and one or more of the gear pumps 10 may be advantageously used in the sump of the rock breaker to return the lubricating fluid back to the main body of the vehicle on which the rock breaker is mounted.

In such rock breaker environment, incorporated herein by reference, the gear pump 10 may often be only partially immersed in lubricating fluid. Nevertheless, even though only one or two of the inlet passages 58 are immersed, fluid will be communicated to the common inlet chambers 63 and result in effective operation of the pump. As the gears 12,14 are respectively rotated in the clockwise and counterclockwise directions, as indicated by the arrows in FIG. 1, fluid in the inlet chambers 63 is desirably urged radially outwardly by centrifugal force adjacent the region of suction 36 and past the gear faces 50 and 52 of each of the gears, as may be noted by reference to FIG. 2. As the individual gear teeth 38 progress angularly away from the zero degree position and fluid is fed to the tooth tips 40 under increasing pressure, air entrained in the fluid accumulates radially inwardly at the tooth roots 42. Thereafter, a portion of the aerated fluid may advantageously escape generally in the regions of the second and third quadrants of each of the gears by direct communication with the common inlet chambers 63. Such air bleed therefor occurs in the leading first portion 61 up to a radial step 74 at about 250°. As is apparent from FIG. 1, the gears and the associated passages are generally arranged symmetrically in a mirror image manner with respect to a midplane 72. Accordingly, while aerated fluid may continue to be urged radially inwardly after about 250°, or beyond the leading first portion 61, it is not freely communicated to the common inlet chambers 63. Rather, any aerated fluid tends to thereafter be forced into communication with the arcuate air bleed passages 64 through the enlarged side clearances provided between the faces 50,54 and 52,56. Such radially inward flow is positively enhanced by the communication of pressurized fluid in the discharge opening 48 to the pressure transmitting grooves 70. Specifically, pressure fluid at about 345 KPa (50 psi) at the discharge opening is communicated to the tooth tips 40 through a preselected angular region embracing a substantial portion of the trailing second portion 62 of from about 355° back to about 275°. This advantageous pressure feedback provision tends to force any remaining air bubbles away from the tooth roots 42 and into the bleed passages 64 throughout the fourth quadrant of each gear as may be visualized by reference to the flow indicating arrows in FIG. 3. Since the aerated fluid is returned to the sump of the rock breaker via the openings 58 and the standpipes 68, substantially deaerated fluid is returned to the primary reservoir, not shown, via the discharge opening 48.

Figure 4:
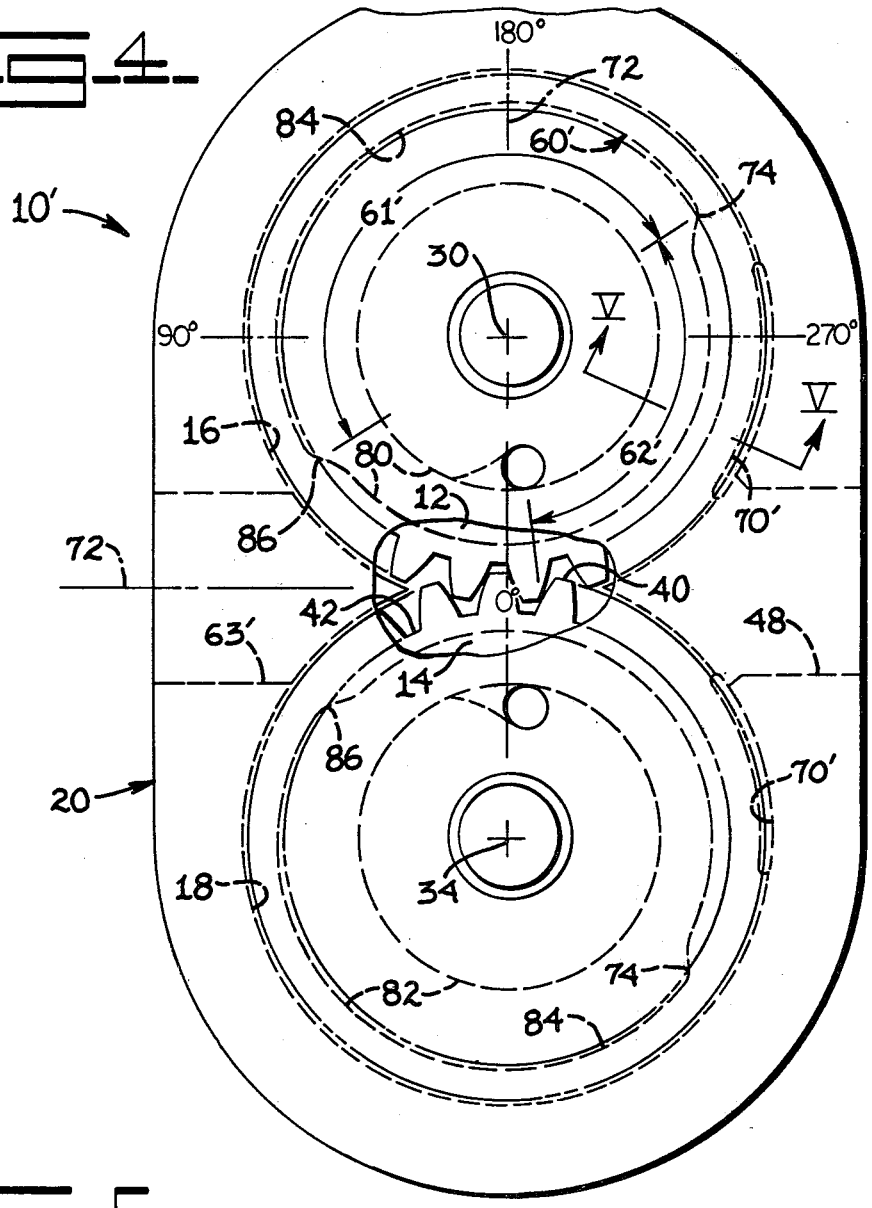
FIG. 4 is a diagrammatic plan view of a second embodiment gear pump constructed in accordance with the present invention with a portion broken open to show details thereof.
Figure 5:
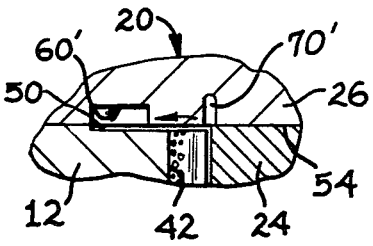
FIG. 5 is a diagrammatic, fragmentary sectional view of the gear pump of FIG. 4 as taken along line V—V thereof.

A second embodiment gear pump 10' is illustrated in FIGS. 4 and 5, with elements corresponding generally to those of the first embodiment being identified by similar reference numerals. The second embodiment differs in that a single fluid inlet opening 63' is provided in the body portion 24 concentrically along a midplane 72 and at right angles to the gear axes 30 and 34, rather than being located in the cover plates 22,26 as in the first embodiment. Moreover, the air bleed passage means 60' includes spaced apart annular air bleed chambers 80 and 82 in at least one of the cover plates. An outer wall 84 of each of the bleed chambers has a radial step 86 in addition to the radial step 74 to allow the bleed chambers to communicate freely with the tooth roots 42 between about 60° and about 240°. In this way as centrifugal force urges fluid radially outwardly, air accumulates at the tooth roots and may flow into the bleed chambers in a preselected angular region embracing the leading portion 61' in a manner comparable to that region described in connection with the first embodiment.

The second embodiment also has grooves 70' substantially in the fourth quadrant of at least one of the cover plates 22,26 for positively urging the flow of air entrained fluid radially inwardly into the annular air bleed chambers 80,82 even though the tooth roots 42 are disconnected from direct communication therewith because of the wall steps 74. Specifically, note that the pressure fluid at the discharge opening 48 is communicated to the tooth tips 40 from about 355° back to about 255° in a preselected angular region contained within the trailing-portion 62'. This pressure feedback provides a second mode of operation comparable to that of the first embodiment and tends to force air bubbles in the fluid radially inwardly past the opposed faces 50,54, for example, and into the collecting air bleed passage means 60' as is illustrated by the fluid flow movement indicating arrow in FIG. 5.

Figure 6:
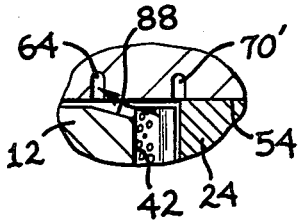
FIG. 6 is a diagrammatic, fragmentary sectional view of a third embodiment gear pump that may be compared with FIG. 3.

As shown in FIG. 6, it is contemplated that each of the tooth roots 42 can be provided with a tapered end groove 88 to better communicate air bubbles and the like to the air bleed passages 64 of gear pump 10, or alternately to the air bleed chambers 80,82 of gear pump 10', not shown. In such instance the tapered end grooves 88 would preferably extend radially inwardly to overlap these bleed passages or bleed chambers.

Other aspects, objects and advantages will become apparent from a study of the specification, drawings and appended claims.

What is claimed is:

1. In a gear pump (10) having a housing (20) defining first and second intersecting cavities (16,18), and first and second intermeshing gears (12,14) having a plurality of teeth (38) and a plurality of tooth roots (42) between the teeth (38), each gear (12,14) positioned respectively in one of the first and second cavities (16,18), the improvement comprising:

air bleed passage means (60) in the housing (20) for passing entrained air collected in the fluid at said gear tooth roots (42) as a result of centrifugal force away from a preselected angular region of each of said cavities (16,18), said air bleed passage means (60) including a leading portion (61) and an adjacent trailing portion (62) in each of the angular regions, said leading portions (61) being in continuous open communication with said tooth roots (42) and having a construction starting in the region from 0° to 90°, continuing through the region from 90° to 180°, and terminating in the region from 180° to 270° relative to a zero degree position of intermeshing contact of said gears (12,14), and said trailing portions (62) being in communication with said tooth roots (42) solely through the side clearance between said gears (12,14) and said housing (20) and having a construction juxtaposed to said leading portions (61).

2. The gear pump (10) of claim 1 including a pump outlet opening (48) and biasing groove means (70) for communicating fluid pressure at said pump outlet opening (48) with said teeth (38) at said trailing portion (62) and urging the movement of entrained air radially inwardly toward said air bleed passage means (60).

3. The gear pump (10) of claim 1 wherein said leading portion (61) is located in a region from about 5° to about 245° relative to a zero degree position of intermeshing contact of said gears (12,14).

4. The gear pump (10) of claim 1 wherein said leading portion (61) is located in a region from about 60° to about 240° relative to a zero degree position of intermeshing contact of said gears (12,14).

5. The gear pump (10) of claim 1 wherein said trailing portion (62) is located in a region from about 245° to about 355° relative to a zero degree position of intermeshing contact of said gears (12,14).

6. The gear pump (10) of claim 1 wherein said trailing portion (62) is located in a region from about 240° to about 355° relative to a zero degree position of intermeshing contact of said gears (12,14).

7. The gear pump (10) of claim 1 wherein said air bleed passage means (60) includes an inlet chamber (63) of generally a figure "8" configuration common to both of said gears (12,14) and a pair of arcuate air bleed passages (64) separated from said inlet chamber (63).

8. The gear pump (10) of claim 1 wherein said tooth roots (42) have tapered end grooves (88) opening selectively into communication with said air bleed passage means (60).

9. The gear pump (10) of claim 1 wherein said air bleed passage means (60) provides a common inlet chamber (63) of generally a figure "8" configuration.

10. The gear pump (10) of claim 1 including an inlet opening (63') and wherein said air bleed passage means (60) includes a pair of annular chambers (80,82) spaced from said inlet opening (63').

11. The gear pump (10) of claim 1 including a pump outlet opening (48) and a pair of pressure transmitting grooves (70) in the housing (20) communicating with said pump outlet opening (48), said grooves (70) being located radially outwardly of said trailing portion (62) of said air bleed passage means (60).

12. The gear pump (10) of claim 1 wherein said air bleed means (60) includes a pair of annular chambers (80,82) in said housing (20).

13. The gear pump (10) of claim 12 wherein said annular chambers (80,82) open radially outwardly on said tooth roots (42) from about 60° to at about 240° relative to a zero degree position of intermeshing contact of said gears (12,14).

14. In a gear pump (10) having a housing (20) defining first and second intersecting cavities (16,18), and first and second intermeshing gears (12,14) having a plurality of teeth (38) and a plurality of tooth roots (42) between the teeth (83), each gear (12,14) positioned respectively in one of the first and second cavities (16,18), the improvement comprising:

air bleed passage means (60) in the housing (20) for passing entrained air collected in the fluid at said gear tooth roots (42) as a result of centrifugal force away from a preselected angular region of each of said cavities (16,18), said air bleed passage means (60) including a leading portion (61) and an adjacent trailing portion (62) in each of the angular regions, said leading portions (61) being in open communication with said tooth roots (42) and said trailing portions (62) being in communication with said tooth roots (42) solely through the side clearance between said gears (12,14) and said housing (20), said air bleed passage means (60) including an inlet chamber (63) common to both of said gears (12,14) and a pair of arcuate bleed passages (64) separated from said inlet chamber (63), said inlet chamber (63) being in open communication with said tooth roots (42) in said leading portions (61) and wherein said arcuate bleed passages (64) extend through a preselected angular region of the trailing portions (62).

15. In a gear pump (10) having a housing (20) defining first and second intersecting cavities (16,18), and first and second intermeshing gears (12,14) having a plurality of teeth (38) and a plurality of tooth roots (42) between the teeth (83), each gear (12,14) positioned respectively in one of the first and second cavities (16,18) the improvement comprising:

air bleed passage means (60) in the housing (20) for passing entrained air collected in the fluid at said gear tooth roots (42) as a result of centrifugal force away from a preselected angular region of each of said cavities (16,18), said air bleed passage means (60) including a leading portion (61) and an adjacent trailing portion (62) in each of the angular regions, said leading portions (61) being in open communication with said tooth roots (42) and said trailing portions (62) being in communication with said tooth roots (42) solely through the side clearance between said gears (12,14) and said housing (20), said air bleed passage means (60) including an inlet chamber (63) common to both of said gears (12,14) and a pair of arcuate bleed passages (64) separated from said inlet chamber (63), and including a pump outlet opening (48) and biasing groove means (70) for communicating fluid pressure at said pump outlet opening (48) with said teeth (38), said biasing groove means (70) being located radially outwardly of said arcuate air bleed passages (64).

* * * * *